US010016995B2

(12) United States Patent
Onodera

(10) Patent No.: US 10,016,995 B2
(45) Date of Patent: Jul. 10, 2018

(54) OPENING/CLOSING APPARATUS AND PRINTER HAVING OPENING/CLOSING APPARATUS

(71) Applicant: SATO HOLDINGS KABUSHIKI KAISHA, Tokyo (JP)

(72) Inventor: Hitoshi Onodera, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 322 days.

(21) Appl. No.: 14/381,871

(22) PCT Filed: Feb. 22, 2013

(86) PCT No.: PCT/JP2013/054599
§ 371 (c)(1),
(2) Date: Aug. 28, 2014

(87) PCT Pub. No.: WO2013/129264
PCT Pub. Date: Sep. 6, 2013

(65) Prior Publication Data

US 2015/0042742 A1 Feb. 12, 2015

(30) Foreign Application Priority Data

Feb. 29, 2012 (JP) ..... 2012-043617

(51) Int. Cl.
*B41J 2/325* (2006.01)
*B65D 43/14* (2006.01)
(Continued)

(52) U.S. Cl.
CPC ..... *B41J 29/02* (2013.01); *B41J 11/04* (2013.01); *B41J 29/13* (2013.01)

(58) Field of Classification Search
CPC ..... B41J 29/13; B41J 29/02; B41J 11/04
(Continued)

(56) References Cited

U.S. PATENT DOCUMENTS 6,929,302 B1 * 8/2005 Demick ..... B60P 3/341 296/170
9,027,936 B2 * 5/2015 Yoshitsune ..... F16J 15/061 277/591
(Continued)

FOREIGN PATENT DOCUMENTS

EP 2090792 A1 * 8/2009 ..... G06F 1/1616
EP 2108517 A1 10/2009
(Continued)

OTHER PUBLICATIONS

International Search Report dated May 21, 2013 issued in corresponding International patent application No. PCT/JP2013/054599.
(Continued)

*Primary Examiner* — Roy Y Yi
*Assistant Examiner* — Douglas Kay
(74) *Attorney, Agent, or Firm* — Ostrolenk Faber LLP

(57) ABSTRACT

A two-way-openable printer includes a hinge portion for connecting an upper unit and a lower unit, provided at the rear of the printer, and a paper ejection opening of the printer at the front. The hinge portion has a lower hinge bracket connected to the lower unit, an upper hinge bracket connected to the lower hinge bracket with a pivot pin and pivotable about the pivot pin, and a bracket cover for the upper hinge bracket. The upper unit has a portion which allows the upper unit to pivot about the bracket cover. The upper unit has a first opening mode in which it is opened at the front ejection opening side, and a second opening mode in which it is fully opened by pivoting at the hinge portion so that a first side surface of the upper unit faces downward and an opposite side surface faces upward.

14 Claims, 12 Drawing Sheets

(51) Int. Cl.

| | |
|---|---|
| ***B41J 29/02*** | (2006.01) |
| ***B41J 29/13*** | (2006.01) |
| ***B41J 11/04*** | (2006.01) |

(58) Field of Classification Search
USPC ..... 347/197, 222, 220; 220/831, 818; 174/67
See application file for complete search history.

(56) References Cited

U.S. PATENT DOCUMENTS

| | | | | |
|---|---|---|---|---|
| 2006/0185123 | A1 | 8/2006 | Kuramochi | 16/221 |
| 2010/0301687 | A1* | 12/2010 | Nagao | H02K 5/08 310/43 |
| 2011/0193926 | A1* | 8/2011 | Matsushima et al. | 347/197 |
| 2012/0111597 | A1* | 5/2012 | Korcz et al. | 174/67 |
| 2012/0212562 | A1* | 8/2012 | Tsugaru | 347/222 |

FOREIGN PATENT DOCUMENTS

| | | | |
|---|---|---|---|
| EP | 2146488 | A1 | 1/2010 |
| JP | 60-78463 | | 5/1985 |
| JP | 2001-3911 | | 1/2001 |
| JP | 2001-83756 | | 3/2001 |
| JP | 2001-158547 | | 6/2001 |
| JP | 2002-370417 | | 12/2002 |
| JP | 2003-237368 | | 8/2003 |
| JP | 2008-138796 | | 6/2008 |
| JP | 2008138796 | A * | 6/2008 |
| JP | 2008-183871 | | 8/2008 |
| JP | 2009-119827 | | 6/2009 |
| JP | 2010-170003 | | 8/2010 |

OTHER PUBLICATIONS

European Search Report, dated Sep. 8, 2016, issued in corresponding European Patent Application No. EP13754783.2. Total 8 pages.

* cited by examiner

OPENING/CLOSING APPARATUS AND PRINTER HAVING OPENING/CLOSING APPARATUS

CROSS-REFERENCE TO RELATED APPLICATIONS

The present application is a 35 U.S.C. §§ 371 National Phase conversion of PCT/JP2013/054599, filed Feb. 22, 2013, which claims priority of Japanese Application No. 2012-043617, filed Feb. 29, 2012, the contents of which are incorporated by reference herein. The PCT International Application was published in the Japanese language.

BACKGROUND

Technical Field

The present invention relates to a printer composed of an upper unit and a lower unit, and more particularly, to an opening/closing apparatus for opening and closing an upper unit relative to a lower unit, and a printer having the opening/closing apparatus.

Related Art

A printer composed of an upper unit and a lower unit conventionally has a structure in which the upper unit opens relative to the lower unit for maintenance or other purposes. Printers having such a structure are disclosed, for example, in JP 2001-158547 A and JP 2009-119827 A.

A thermal printer disclosed in JP 2001-158547 A has a lower unit that includes a print section having a thermal head and a motor for feeding paper, and an upper unit that includes a platen. The upper unit is mounted at a side portion along a paper feed direction such that it can open and close laterally relative to the thermal head. The lower unit is provided with a planetary gear mechanism that is driven by the motor and meshes with a platen gear of the upper unit when the upper unit is placed on the thermal head and the motor is energized.

With this, it is intended to solve problems such as damage to gears and a meshing failure due to a collision between a platen gear and a drive gear when an upper unit is closed, which occurs in a thermal printer with a laterally opening and closing structure in which the pivot center of an upper unit is provided at a side portion of the apparatus along a direction parallel to a paper feed direction, and the upper unit is opened in a direction orthogonal to the paper feed direction.

A printer disclosed in JP 2009-119827 A has, in order to provide a printer in which a guide roller does not interfere with an operation of changing an ink ribbon or a roll, and a reduction in an apparatus width, a guide roller placed on the inner side of a cover, supported by a guide roller support member, in which by closing the cover, the guide roller support member is inserted, from between the pair of arms, between the print unit and the roll support unit to dispose the guide roller in a given position. This printer has a hinge at a back portion, and has a structure in which an upper casing opens upward at the front side.

The printer disclosed in JP 2001-158547 A opens only in a lateral direction while having a paper ejection side of the printer at the front. The printer disclosed in JP 2009-119827 A opens only in a rear direction.

Therefore, the printer disclosed in JP 2001-158547 A is difficult to maintain in a place with no space in a lateral direction because the upper unit cannot be opened. The printer disclosed in JP 2009-119827 A is difficult to maintain in a place with no space in a rear direction because the upper unit cannot be opened.

In view of these problems in the art, it is intended to provide an opening/closing apparatus that allows an upper portion of a printer to be opened both in a lateral direction and in a rear direction, and a printer having the opening/closing apparatus.

Accordingly, a printer may advantageously include a print section having a platen roller for feeding paper and a thermal head for printing on paper fed thereby; a lower unit including one of the platen roller and the thermal head; and an upper unit including the other of the platen roller and the thermal head, the upper unit being able to be opened in a first mode at a front ejection opening side, the upper unit being able to be fully opened in a second mode by unfolding the upper unit such that one side surface of the upper unit faces upward and the other side surface of the upper unit faces downward.

A printer may further include a print section having a platen roller for feeding paper and a thermal head for printing on paper fed thereby; a lower unit including one of the platen roller and the thermal head; an upper unit including the other of the platen roller and the thermal head; a first pivot support portion provided along a direction parallel to a longitudinal direction of the platen roller, the first pivot support portion pivotably supporting the upper unit relative to the lower unit; and a second pivot support portion provided along a direction orthogonal to the longitudinal direction of the platen roller, the second pivot support portion pivotably supporting one end portion of the first pivot support portion.

Thus, the upper unit of the printer can be opened and closed both in a rear direction and in a lateral direction.

In the described printer, the first pivot support portion advantageously has a biasing portion for biasing the upper unit in a direction in which the upper unit is opened relative to the lower unit. With this, the upper unit of the printer can be easily maintained in a state of opening in a rear direction.

The printer may further include a locking portion that allows the upper unit to be locked and unlocked into a closed state and an open state relative to the lower unit.

Thus, the upper unit can be prevented from opening unnecessarily.

Furthermore, in the printer, the first pivot support portion is preferably provided at the upper unit; and a connecting portion is provided at the lower unit, the connecting portion pivotably supporting the upper unit on the first pivot support portion, and pivotably supporting the first pivot support portion on the second pivot support portion in an attachable and detachable manner. Thus, the upper unit of the printer can be pivoted without wobbling in a rear direction, and also can be pivoted easily in a lateral direction.

In the printer also, the first pivot support portion and the upper unit may be provided with a restricting portion that restricts the amount of pivoting of the upper unit that pivots on the first pivot support portion. Thus, the opening width in a rear direction can be made constant.

Further, the first pivot support portion may be constituted by a member having elasticity.

Furthermore, the connecting portion may have a first groove for supporting one end portion of the first pivot support portion that is supported by the second pivot support portion, and a second groove for supporting the other end portion of the first pivot support portion, the first groove having an opening formed to face vertically upward, the second groove having an opening formed at an inclination with respect to a vertically top portion. Thus, the upper unit can be pivoted toward the rear without wobbling.

The second groove may be formed with a protruding portion at which an inner wall of the groove is protruded on a path of the other end portion of the first pivot support portion when the first pivot support portion pivots on the second pivot support portion. Thus, the upper unit can be pivoted toward the rear without wobbling.

Further, an opening/closing apparatus may include a lower unit; an upper unit that is openable and closable relative to the lower unit; a first pivot support portion constituting a pivot whereby the upper unit is opened or closed in a first direction; and a second pivot support portion for supporting one end portion of the first pivot support portion, the second pivot support portion constituting a pivot whereby the upper unit is opened or closed in a second direction that is different from the first direction. Thus, the upper unit can be opened and closed both in a rear direction and in a lateral direction.

In the opening/closing apparatus, the first pivot support portion may have a biasing portion for biasing the upper unit in a direction in which the upper unit is released relative to the lower unit. Thus, the upper unit can be easily maintained in a state of opening in a rear direction.

The opening/closing apparatus may further include a locking portion that allows the upper unit to be locked and unlocked into a closed state and a released state relative to the lower unit. Thus, the upper unit can be prevented from opening when it is unnecessary.

Further, in the opening/closing apparatus, the first pivot support portion may be provided at the upper unit; and a connecting portion provided at the lower unit, the connecting portion pivotably supporting the upper unit on the first pivot support portion, and pivotably supporting the first pivot support portion on the second pivot support portion in an attachable and detachable manner. Thus, the upper unit of the printer can be pivoted without wobbling in a rear direction, and also can be easily pivoted in a lateral direction.

Furthermore, in the opening/closing apparatus, the first pivot support portion and the upper unit may be provided with a restricting portion for restricting the amount of pivoting of the upper unit that pivots on the first pivot support portion. Thus, the opening width in a rear direction can be made constant.

Also in the opening/closing apparatus, the first pivot support portion may be constituted by a member having elasticity.

The connecting portion may have a first groove for supporting one end portion of the first pivot support portion that is supported by the second pivot support portion, and a second groove for supporting the other end portion of the first pivot support portion, the first groove having an opening formed to face vertically upward, the second groove having an opening formed at an inclination with respect to a vertically top portion. Thus, the upper unit can be pivoted toward the rear without wobbling.

Furthermore, the second groove may be formed with a protruding portion at which an inner wall of the groove is protruded on a path of the other end portion of the first pivot support portion when the first pivot support portion pivots on the second pivot support portion.

Thus, the upper unit can be pivoted toward the rear without wobbling.

Thus, the disclosed opening/closing apparatus allows an upper portion of a printer to be opened both in a lateral direction and in a rear direction, and a printer with the opening/closing apparatus is described as well.

DETAILED DESCRIPTION

Figure 1A:
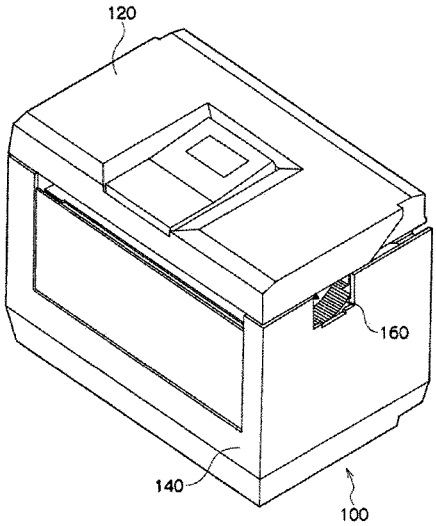
FIG. 1(A) is a perspective view of a printer.

Hereinafter, with reference to the accompanying drawings, an embodiment of the present invention will be described in detail. Here, in the drawings, portions denoted by identical symbols are similar elements having similar functions. In this specification, a thermal head printer is illustrated as an example, but the present invention is not limited to thermal head printers, and can be widely applied to printers in general.

<Configuration>

(1) Schematic Configuration

Figure 1B:
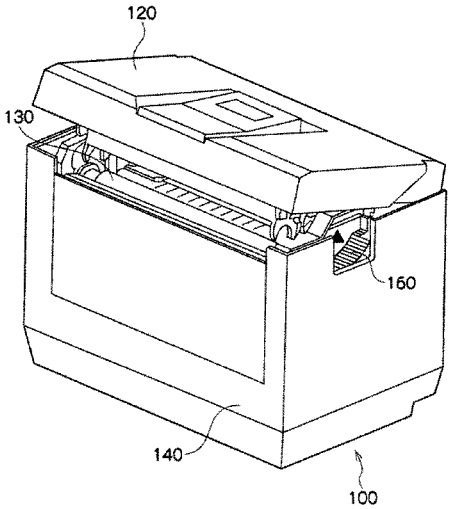
FIG. 1(B) is a perspective view of the printer with an upper unit opened.
Figure 1C:
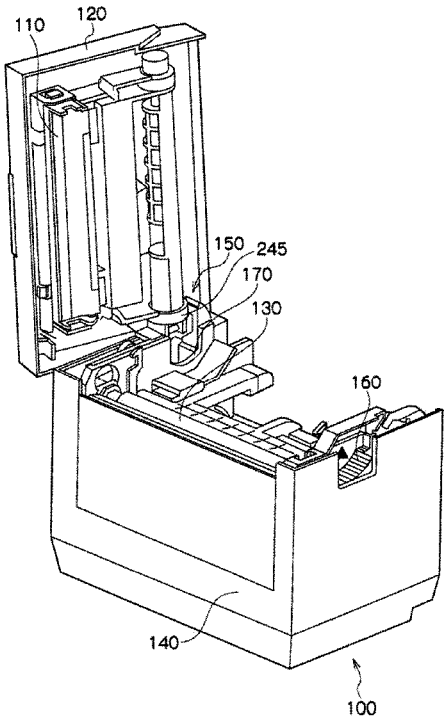
FIG. 1(C) is a perspective view of the printer with the upper unit fully opened.

A printer according to the present invention will be described with reference to FIGS. 1(A) to 1(C). FIG. 1(A) is a perspective view of a printer. FIG. 1(B) is a perspective view of the printer with an upper unit opened. FIG. 1(C) is a perspective view of the printer with the upper unit fully opened.

Referring to FIGS. 1(A) to 1(C), a printer 100 according to the present invention is composed mainly of an upper unit 120 mainly including a thermal head 110, a lower unit 140 mainly including a platen roller 130, a motor (not shown), and a controller (not shown), and a hinge portion 150 connecting the upper unit 120 and the lower unit 140 in an openable and closable manner. The thermal head 110 that prints on a print medium with the upper unit 120 closed relative to the lower unit 140 as shown in FIG. 1(A), and the platen roller 130 for feeding paper are configured as a print section. In FIG. 1(A), an insertion opening is provided through which a print medium is inserted from a side on which the hinge portion 150 is provided, and an ejection opening from which a print medium is ejected is provided on a side on which the print section is provided. A print medium is fed from the insertion opening (upstream in a feeding direction) toward the ejection opening (downstream in the feeding direction).

Here, an element included in the upper unit 120 and an element included in the lower unit 140 are not limited to the above-described combination, and can be combined as desired. That is, the upper unit 120 may be configured to include the platen roller 130, and the lower unit 140 may be configured to include the thermal head. Any other combination is also possible.

In the present embodiment, a front side means the ejection opening side of the printer 100 located downstream in the feeding direction of a print medium, and a rear side means the insertion opening side of the printer 100 located upstream in the feeding direction of a print medium. A left side means the side of a left side surface of the printer 100 viewed with the front side forward, and a right side means the side of a right side surface of the printer 100 viewed with the front side forward. A side surface mentioned simply means a right side surface or a left side surface, and a side surface side mentioned simply means the right side or the left side.

In the present embodiment, front opening means opening the ejection opening side as shown in FIG. 1(B), and full opening means opening by unfolding the upper unit 120 such that one side surface thereof faces upward and the other side surface thereof faces downward as shown in FIG. 1(C).

(2) Configuration of Opening and Closing Apparatus (Hinge Portion)

An opening/closing apparatus (hinge portion) is mainly composed of a first pivot support portion for pivotably supporting the upper unit 120 relative to the lower unit 140, and a second pivot support portion for pivotably supporting one end portion of the first pivot support portion. The first pivot support portion is provided along a direction parallel to a longitudinal direction of the platen roller 130. The second pivot support portion is provided along a direction perpendicular to the longitudinal direction of the platen roller 130. Hereinafter, the opening/closing apparatus will be described as the hinge portion.

Figure 2:
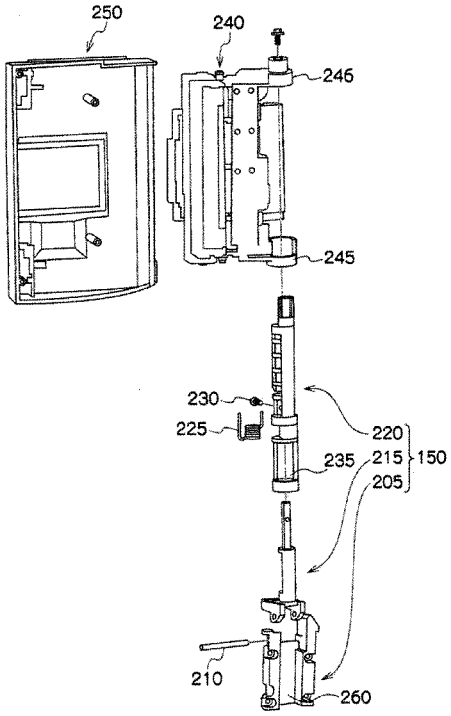
FIG. 2 is an exploded view of a hinge portion and a part of the upper unit.

The configuration of the hinge portion will be further described with reference to the drawings. FIG. 2 is an exploded view of the hinge portion and a portion of the upper unit. As shown in FIG. 2, the hinge portion 150 mainly includes the first pivot support portion composed of an upper hinge bracket 215 and a bracket cover 220, the second pivot support portion composed of a lower hinge bracket 205 and a pivot pin 210, a spring 225 (biasing portion), and a screw 230.

The spring 225 as a biasing portion biases the upper unit 120 in a direction in which the upper unit 120 is released relative to the lower unit 140. Thus, the biasing portion may be any that provides a biasing force to the upper unit 120. Various elastic members other than springs may be used as the biasing portion.

The lower hinge bracket 205 has opposite side edge portions extended, and is formed with a hole in each extended portion for inserting the pivot pin 210 therethrough. One end of the upper hinge bracket 215 is provided with a fork portion divided into two parts. The two separate parts of the fork portion are each formed with a hole for inserting the pivot pin 210 therethrough.

The fork portion of the upper hinge bracket 215 is inserted between the extended two portions (hereinafter, referred to as extended portions) of the lower hinge bracket 205. The pivot pin 210 is inserted through the two holes formed in the extended portions and the two holes in the fork parts. This allows the upper hinge bracket 215 to pivot on the pivot pin 210 relative to the lower hinge bracket 205.

The bracket cover 220 has, at one end portion, an insertion hole 235 for inserting the upper hinge bracket 215 thereinto in an axial direction. The upper hinge bracket 215 is inserted into the insertion hole 235. At this time, when inserted into the insertion hole 235, the upper hinge bracket 215 is placed in the insertion hole 235, passing through a hole of a ring formed by the spring 225 that is placed in the insertion hole 235.

Figure 3:
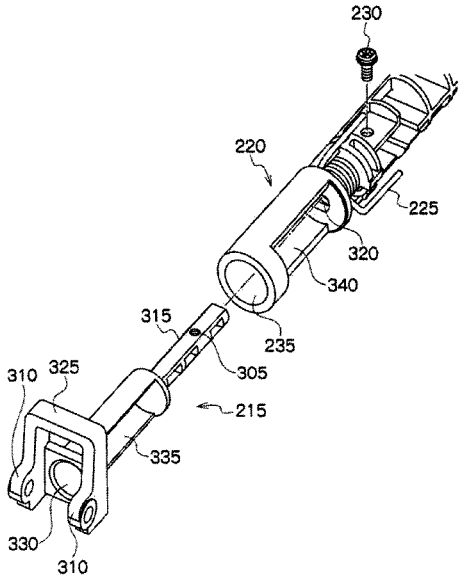
FIG. 3 is an exploded view of an upper hinge bracket and a bracket cover.

FIG. 3 is an exploded view of the upper hinge bracket and the bracket cover. A distal end portion of the upper hinge bracket 215 on the side on which fork parts 310, 310 are not formed is a rod-shaped body 315 composed of a set of opposing flat surface portions and a set of opposing curved surface portions. The fork parts 310, 310 are connected with a U-member 325 in a substantially inverted U shape.

This rod-shaped body 315 (hereinafter, the distal end portion of the upper hinge bracket is referred simply as a rod-shaped body) is, as shown in FIG. 3, inserted into a pivot stopping hole 320 that is provided in the insertion hole 235 of the bracket cover 220 and has a shape identical to the outer shape of the rod-shaped body 315.

With this, the set of flat surface portions around the rod-shaped body abut flat surface portions of the pivot stopping hole 320 into which the rod-shaped body 315 is inserted, functioning as a pivot stopper, and thus preventing the rod-shaped body 315 (that is, the upper hinge bracket) from turning freely relative to the bracket cover 220.

Figure 4:
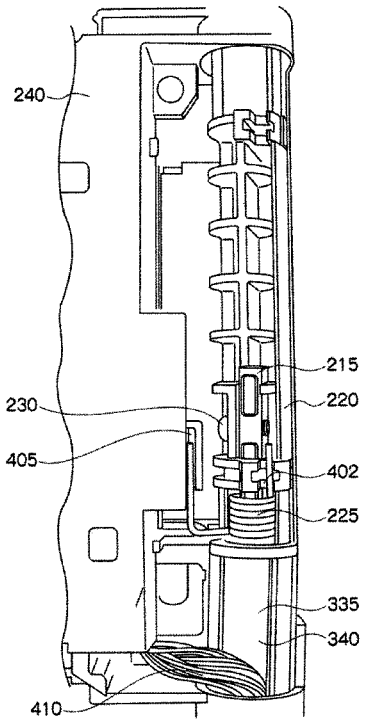
FIG. 4 is a schematic view when the hinge portion is incorporated into an upper casing.

The upper hinge bracket has a screw hole 305. As shown in FIGS. 3 and 4 (FIG. 4 is a schematic view when the hinge portion is incorporated into an upper casing), the screw 230 fastens the bracket cover 220 and the upper hinge bracket 215. This can prevent the upper hinge bracket 215 from coming out of the bracket cover 220. Here, the upper hinge bracket 215 and the bracket cover 220 do not need to be separate bodies, and may be an integrated component. For example, they may have a structure in which the upper hinge bracket is contained in the bracket cover.

Referring to FIG. 2, an upper casing 240 has a substantially rectangular parallelepiped shape. Of two sets of opposing edges thereof constituting a surface with the largest area, one set of edges are extended. Extended portions are formed with ring portions 245 and 246, individually, which have holes for inserting the bracket cover 220 therethrough. Here, this example has two ring portions as an example for illustration, but the number of the ring portions is not limited to this. The number may be any that is more than or equal to one.

The bracket cover 220 into which the upper hinge bracket 215 is inserted is inserted through the ring portions 245 and 246. Referring to FIG. 4, the spring 225 has one distal end portion disposed in a groove 402 that is provided in the bracket cover 220, and has the other distal end portion disposed in a groove 405 provided in the upper casing 240. This spring 225 biases the upper casing 240 in a direction in which it pivots about the bracket cover 220. As shown in FIG. 2, the upper casing 240 is joined to an upper cover 250.

Figure 5:
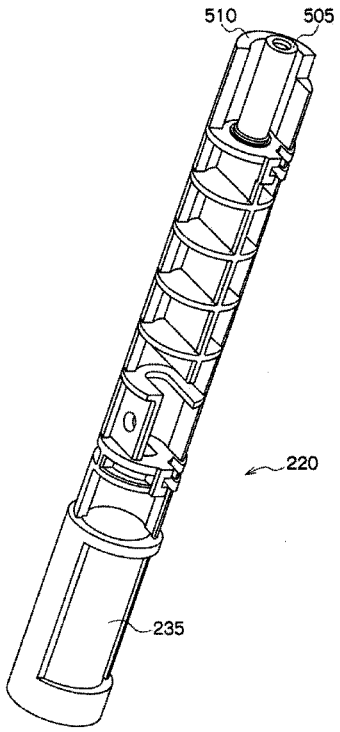
FIG. 5 is a perspective view of the bracket cover.
Figure 6:
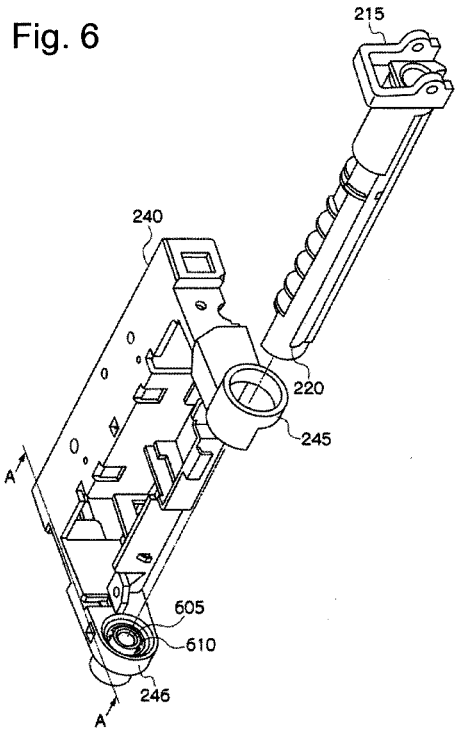
FIG. 6 is an exploded view of the upper casing and the bracket cover.
Figure 7:
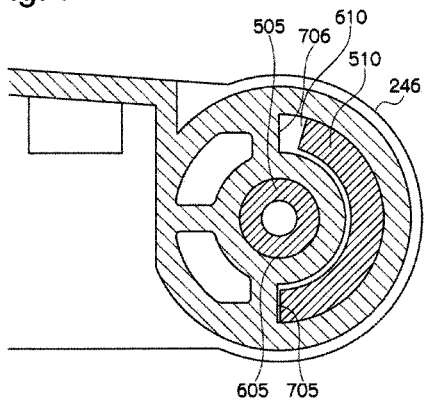
FIG. 7 is a cross-sectional view along A-A in FIG. 6 when the bracket cover pivots to the right.
Figure 8:
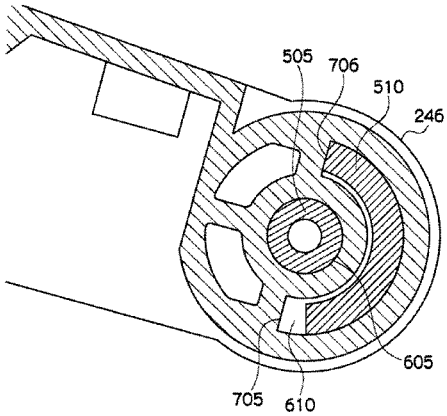
FIG. 8 is a cross-sectional view along A-A in FIG. 6 when the bracket cover pivots to the left.

The bracket cover 220 and the upper casing 240 will be further described with reference to FIGS. 5 to 8. FIG. 5 is a perspective view of the bracket cover. FIG. 6 is an exploded view of the upper casing and the bracket cover. FIG. 7 is a cross-sectional view along A-A in FIG. 6, and is a view when the bracket cover pivots to the right. FIG. 8 is a cross-sectional view along A-A in FIG. 6, and is a view when the bracket cover pivots to the left.

As shown in FIG. 5, one distal end portion of the bracket cover 220 is composed of a hollow cylindrical member 505 and an arc-shaped member 510 disposed around the cylindrical member 505, covering the periphery thereof in an arc shape in cross section.

FIGS. 7 and 8 are A-A cross-sectional views when the bracket cover 220 is inserted from the ring portion 245 to the ring portion 246 of the upper casing 240 as shown in FIG. 6. As shown in FIGS. 6, 7, and 8, the ring portion 246 has a circular hole 605 into which the cylindrical member 505 is inserted and an arc-shaped hole 610 into which the arc-shaped member 510 is inserted.

As shown in FIGS. 7 and 8, the cylindrical member 505 inserted into the circular hole 605 can pivot in the circular hole 605, and the arc-shaped member 510 also can pivot in the arc-shaped hole 610. The arc-shaped hole 610 is formed with stoppers 705 and 706 against which the arc-shaped member 510 butts when pivoting.

As shown in FIG. 7, when the ring portion 246 pivots counterclockwise on the figure, it can pivot until the stopper 705 butts against a lower end of the arc-shaped member 510. As shown in FIG. 8, when the ring portion 246 pivots clockwise, it can pivot until the stopper 706 butts against an upper end of the arc-shaped member 510.

Therefore, when the bracket cover 220 is fixed, the upper casing 240 can pivot about the bracket cover 220 in a range until the stopper 705 or 706 butts against the upper or lower end of the arc-shaped member 510.

Thus, the stoppers 705 and 706 provided at the upper unit 120 and the arc-shaped member 510 provided at the first pivot support portion serve as a restricting portion for restricting the amount of pivoting of the upper unit 120 that pivots on the first pivot support portion.

Figure 9:
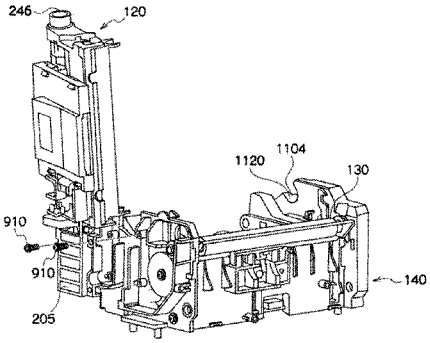
FIG. 9 is an exploded view of a lower unit and the upper hinge bracket.
Figure 10:
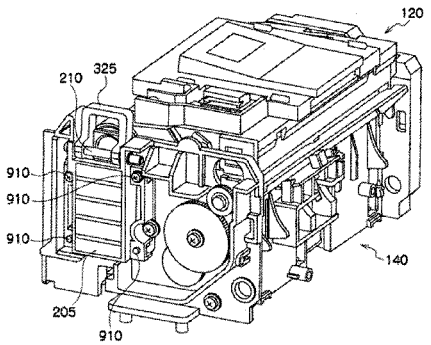
FIG. 10 is a perspective view of the lower unit and the upper unit with their covers removed.

Next, a joint between the lower hinge bracket 205 and the lower unit 140 will be described with reference to FIGS. 9 and 10. FIG. 9 is an exploded view of the lower unit and the upper hinge bracket. FIG. 10 is a perspective view of the lower unit and the upper unit with their covers removed.

As shown in FIGS. 9 and 10, the lower hinge bracket 205 is joined to a left side surface of the lower unit 140 with screws 910.

Next, description will be given below of an embodiment in which a connecting portion is provided at the lower unit 140 when the first pivot support portion is provided at the upper unit 120, wherein the connecting portion pivotably supports the upper unit 120 on the first pivot support portion, and pivotably supports the first pivot support portion on the second pivot support portion and also supports the first pivot support portion in an attachable/detachable manner.

Figure 11A:
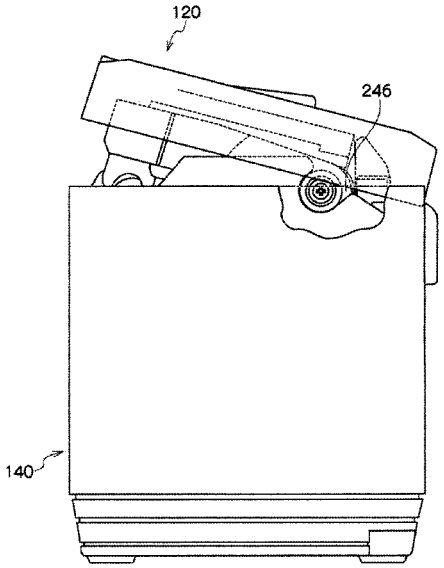
FIG. 11(A) is a side schematic view of the printer in a front open state.
Figure 11B:
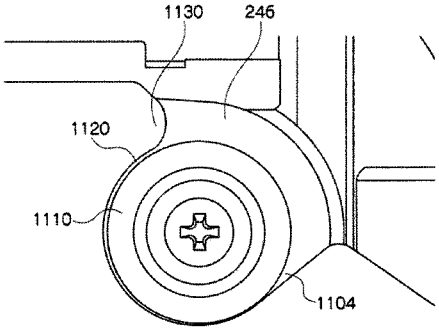
FIG. 11(B) is an enlarged view of a portion in FIG. 11(A).
Figure 12A:
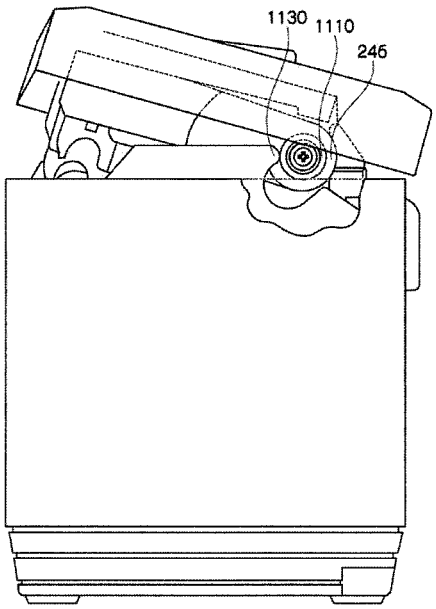
FIG. 12(A) is a side schematic view of the printer during a transition from the front open state to a fully open state.
Figure 12B:
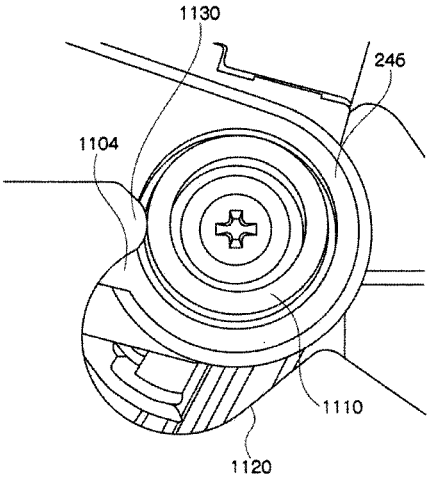
FIG. 12(B) is an enlarged view of a portion in FIG. 12(A).
Figure 13A:
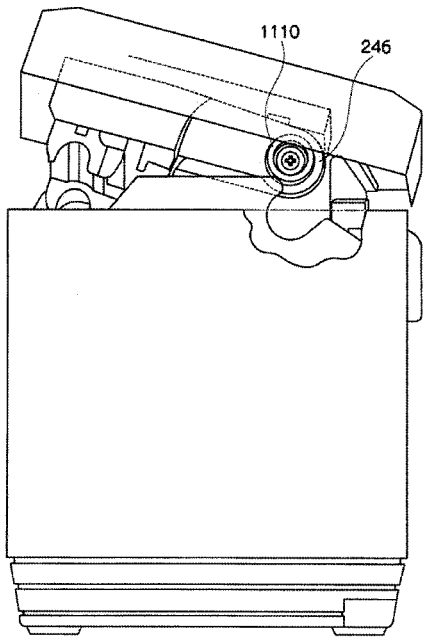
FIG. 13(A) is a side schematic view of the printer during a transition from the front open state to the fully open state.
Figure 13B:
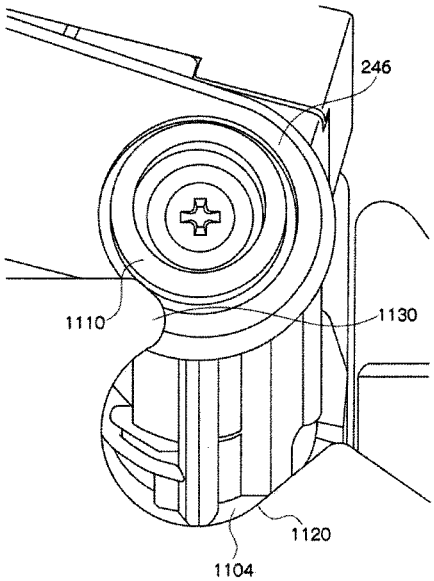
FIG. 13(B) is an enlarged view of a portion in FIG. 13(A).

A connecting portion for connecting the upper unit 120 and the lower unit 140 at a right side surface in a detachable manner will be described with reference to FIGS. 1(C) and 11(A) to 13(B). FIG. 11(A) is a side schematic view of the printer in a front open state. FIG. 11(B) is an enlarged view of a portion in FIG. 11(A). FIG. 12(A) is a side schematic view of the printer during a transition from the front open state to a fully open state. FIG. 12(B) is an enlarged view of a portion in FIG. 12(A). FIG. 13(A) is a side schematic view of the printer during a transition from the front open state to the fully open state. FIG. 13(B) is an enlarged view of a portion in FIG. 13(A).

As shown in FIGS. 1(C), 11(A), and 11(B), the connecting portion is composed of a first groove 170 and a semicircular groove 1104 that constitutes a second groove (see also FIG. 9). In the front open state, a circular protrusion 1110 formed at the ring portion 246 is disposed in the semicircular groove 1104 formed in the lower unit 140.

The ring portion 245 is disposed in the first groove 170 formed in the lower unit 140. The first groove 170 is a groove including a portion that is substantially semicircular in cross section and has a diameter equal to or slightly larger than the diameter of the ring portion 245. An opening thereof is formed to face vertically upward.

The semicircular groove 1104 constituting the second groove is a groove that is substantially semicircular in cross section and has a diameter equal to or slightly larger than the diameter of the circular protrusion 1110. In cross section, an opening larger than the diameter of the circular protrusion 1110 is formed in a position inclined with respect to a vertically top portion.

The semicircular groove 1104 constituting the second groove is further formed with a protruding portion 1130 at which an inner wall of the groove is protruded on a path of a second groove side end portion (other end portion) of the first pivot support portion when pivoting on the second pivot support portion. Here, of the opposite end portions of the first pivot support portion, the first groove side end portion is one end portion, and the second groove side end portion is the other end portion. That is, the protruding portion 1130 at which the inner wall of the groove forming the semicircular groove 1104 is protruded is formed on the path when the second groove side end portion (other end portion) of the first pivot support portion is pivoted on the second pivot support portion upward from the second groove. Thus, the protruding portion 1130 is located on the path of the other end portion of the first pivot support portion pivoting upward from within the second groove, so that the first pivot support portion can be prevented from coming out from within the second groove also when the upper unit 120 is opened at the front, resulting in stable front opening. In order to fully open the upper unit 120, the second groove side end portion (other end portion) of the first pivot support portion is moved toward the opening of the second groove, and the end portion of the first pivot support portion is taken out from within the first groove through the opening, and then the upper unit 120 is pivoted, thereby being able to be easily fully opened.

In other words, the semicircular groove 1104 is a groove formed by a wall 1120 forming an arc in cross section in parallel to a side surface of the lower unit (see also FIG. 9). The circular protrusion 1110 is placed in this groove, and is pivotable in this groove. The size of the opening of this groove is a size larger than or equal to the diameter of the circular protrusion 1110 so that the circular protrusion 1110 can be attached and detached. The wall 1120 forming the semicircular groove 1104 and the protruding portion 1130 are disposed at a vertically upper portion of the circular protrusion 1110. Therefore, for the fully open state, as shown in FIGS. 12(A), 13(A), and 13(B), it is necessary to apply a force to the circular protrusion 1110 to move it in the direction of the opening of the semicircular groove 1104, thus being able to prevent an automatic movement from the front open state to the fully open state, and allows the front open state to be held stably.

The size of the semicircular groove 1104 is preferably smaller (shorter in diameter) to the extent that the circular protrusion 1110 can slide in rotational directions. This can prevent backlash in the upper unit, and allows smooth opening and closing of the upper unit from a closed state to the front open state and vice versa.

(3) Wiring Configuration at Hinge Portion

Figure 14:
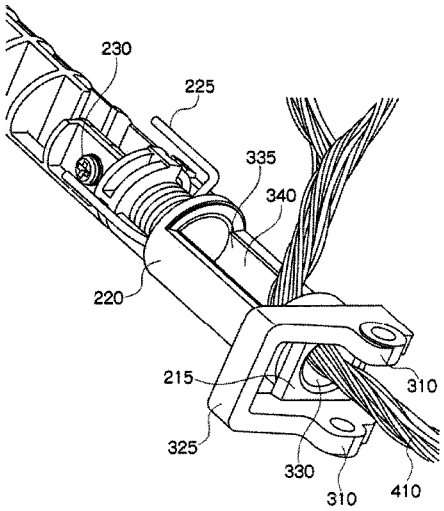
FIG. 14 is a perspective view showing wiring at the hinge portion.
Figure 15:
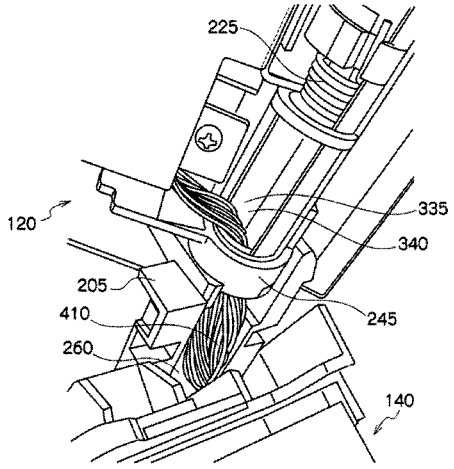
FIG. 15 is a perspective view showing the wiring at the hinge portion when the lower hinge bracket is removed from the lower unit.

Next, a wiring configuration of the hinge portion 150 will be described with reference to FIGS. 2, 3, 4, 14, and 15. FIG. 14 is a perspective view showing wiring at the hinge portion. FIG. 15 is a perspective view showing the wiring at the hinge portion when the lower hinge bracket is slightly removed from the lower unit.

As shown in FIG. 2, the lower hinge bracket 205 has opposite side edge portions extended, and is formed with a hole for inserting the pivot pin 210 therethrough in each of the extended portions, and is formed with a wiring groove 260 for accommodating wiring vertically therethrough between the opposite side edge portions.

Referring to FIG. 3, the upper hinge bracket 215 has a distal end surface hole 330 formed in a distal end surface on the side on which the fork portion is formed, and a first side surface hole 335 formed in a side surface and communicating with the distal end surface hole 330.

Further, a second side surface hole 340 is formed in a side surface of the bracket cover 220. The first side surface hole 335 and the second side surface hole 340 are configured to communicate after assembly. Thus, the distal end surface hole 330 will communicate with the second side surface hole 340.

As shown in FIGS. 4, 14, and 15, wiring 410 from the lower unit 140 to the upper unit 120 passes through the wiring groove 260 of the lower hinge bracket 205, and through the distal end surface hole 330 of the upper hinge bracket 215, the first side surface hole 335 of the upper hinge bracket 215, and the second side surface hole 340 of the bracket cover 220, and is connected to the thermal head 110 provided at the upper unit 120, a board of a display monitor, and others.

Therefore, even when the upper unit 120 repeats front opening or full opening, since the wiring passes through the inside of the hinge portion 150, the wiring is not caught between the upper unit 120 and the lower unit 140, and swinging of the hinge portion does not apply an undue force such as tension to the wiring.

(4) Configuration of Thermal Head Mounting Portion

Figure 16:
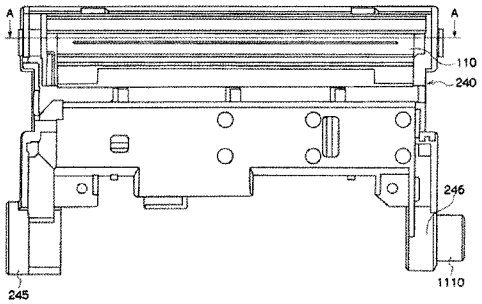
FIG. 16 is a perspective view of a lower surface of the upper casing to which a thermal head is attached.
Figure 17:
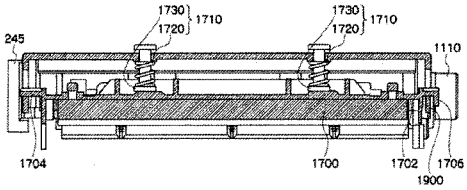
FIG. 17 is a cross-sectional view along A-A in FIG. 16.
Figure 18:
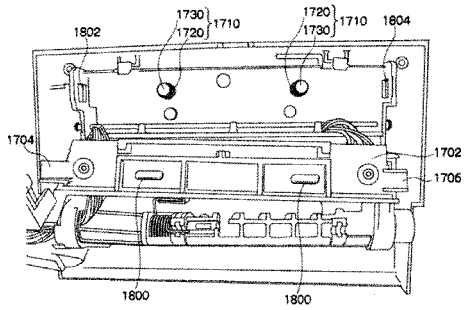
FIG. 18 is a perspective view of a state in which the thermal head is detached from the upper casing.
Figure 19:
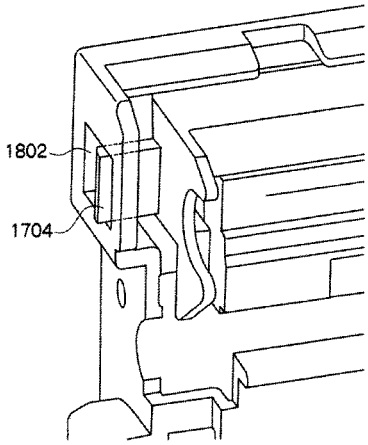
FIG. 19 is a perspective view showing a state of connection between a flat plate member and a rectangular hole.
Figure 20:
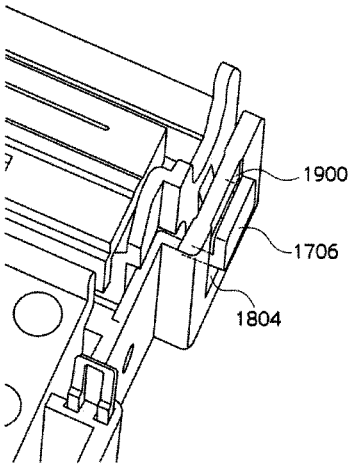
FIG. 20 is a perspective view showing a state of connection between an L-member and a rectangular hole.

Next, the configuration of a connecting portion between the thermal head 110 and the upper casing 240 will be described with reference to FIGS. 16 to 20. FIG. 16 is a perspective view of a lower surface of the upper casing to which the thermal head is attached. FIG. 17 is a cross-sectional view along A-A in FIG. 16. FIG. 18 is a perspective view of a state in which the thermal head is detached from the upper casing. FIG. 19 is a perspective view showing a state of connection between a flat plate member and a rectangular hole. FIG. 20 is a perspective view showing a state of connection between an L-member and a rectangular hole.

As shown in FIG. 16, the thermal head 110 is attached to the upper casing 240. Referring to FIG. 17 that is a cross-sectional view along A-A in FIG. 16, the thermal head 110 is composed of a thermal head element 1700 and a mounting member 1702. The thermal head element 1700 is connected to one surface of the mounting member 1702.

The mounting member 1702 has a flat plate member in a flat plate shape at one end in the longitudinal direction, and has an L-member in an L cross-sectional shape at the other end. Referring to FIG. 18, of the surfaces of the mounting member 1702, on a surface opposite to the surface to which the thermal head element 1700 is attached, two laterally elongated protrusions 1800, 1800 are provided.

The upper casing 240 has a rectangular hole 1802 for inserting a flat plate member 1704 thereinto, a rectangular hole 1804 for inserting an L-member 1706 thereinto, and pressing members 1710, 1710 provided in positions to abut the protrusions 1800, 1800 of the mounting member 1702 at the time of attachment. Each pressing member 1710 is composed of a spring 1720 and a pressing plate 1730 in a flat shape. The spring 1720 continuously biases the pressing plate 1730 toward the front in the figure (in a direction in which the spring extends).

Referring to FIGS. 17, 19, and 20, when the thermal head 110 is attached to the upper casing 240, the flat plate member 1704 is inserted into the rectangular hole 1802, the protrusions 1800, 1800 are caused to abut the pressing members 1710 and pressed in so that the springs 1720 contract, and then the mounting member 1702 is slid horizontally to insert the L-member 1706 into the rectangular hole 1804. Thereafter, the L-member 1706 is butted against a butted surface 1900 of a member forming the rectangular hole 1804.

Thus, since the pressing members 1710 abut the protrusions 1800, even when the mounting member 1702 is slid horizontally, being pressed against the pressing members 1710 to insert the L-member 1706 into the rectangular hole 1804, friction is small because contact areas between the protrusions 1800 and the pressing members 1710 are small, allowing smooth sliding.

Therefore, the protrusions 1800 preferably have a length more than or equal to a length by which the mounting member 1702 is slid. The tops of the protrusions 1800 preferably have a smooth surface and shape (for example, a shape like a semicircle in cross section) to reduce friction.

Further, since the mounting member 1702 is butted at the L-member 1706 against the butted surface 1900, and is continuously biased downward in FIG. 17 by the pressing members 1710, the thermal head element 1700 is positioned accurately and is prevented from being displaced from a position in which it is positioned.

(5) Configuration of Paper Guide

Figure 21:
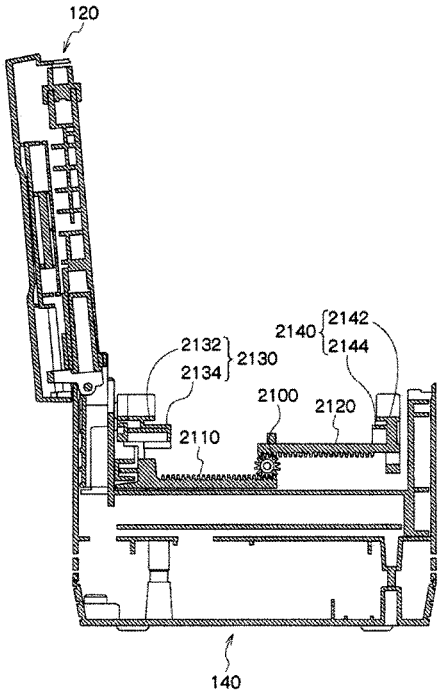
FIG. 21 is a front schematic view of the printer.
Figure 22:
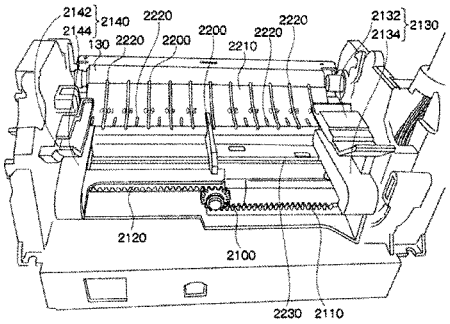
FIG. 22 is a rear perspective view of the printer.

Next, a moving mechanism of a paper guide will be described with reference to FIGS. 21 and 22. FIG. 21 is a front schematic view of the printer. FIG. 22 is a rear perspective view of the printer.

FIG. 21 is a schematic view showing the printer from the front with some components made transparent. Referring to FIGS. 21 and 22, two paper guides 2130 and 2140 that hold paper from both the right and left sides for guiding are composed of upper guides 2132 and 2142 for guiding the upper side of paper and lower guides 2134 and 2144 for guiding the lower side of paper, respectively. The paper guide 2130 has an optical sensor, and can detect the presence or absence of paper.

The paper guide 2130 is connected to a rack 2110 of a rack-and-pinion gear, and the paper guide 2140 is connected to a rack 2120. The rack 2110 and the rack 2120 mesh with a lower portion and an upper portion of a pinion gear 2100 placed perpendicularly to the ground, respectively.

Therefore, when one paper guide is moved, the other paper guide is also moved by the function of the rack-and-pinion gear. Thus the space between the paper guides can be easily adjusted to the paper size.

Further, since the pinion gear 2100 and the racks 2110 and 2120 are placed perpendicularly to the ground, that is, in a vertical orientation, the depth of the printer can be shortened compared with the case where they are placed horizontally to the ground, and the footprint of the printer can be saved in space. Further, since the pinion gear 2100 is placed in the vertical orientation, the dimension in the height direction becomes higher, which facilitates insertion of paper from the rear.

Here, the upper guides 2132 and 2142 desirably extend at their platen roller 130 side distal ends to the vicinity of the platen roller as close as possible. This is because this can prevent a paper jam and also prevent fluttering of paper.

A paper support member 2200 is provided between the two paper guides 2140 and 2030. The paper support member 2200 has a height at a top surface thereof equal to the height of paper contact surfaces of the lower guides 2144 and 2134, and extends from a support plate 2210 that supports paper just to the front of the platen roller 130, to the paper insertion opening.

The paper support member 2200 is located between the two paper guides 2140 and 2130, the two paper guides 2140 and 2130 support both the right and left sides of paper, and the paper support member 2200 supports a central portion of paper, so that paper can be supported stably without drooping and fed to the platen roller. Thus, the paper support member 2200 is preferably placed midway between the two paper guides 2140 and 2130.

The support plate 2210 has a gradual upslope from front side distal ends of the lower guides 2144 and 2133 to the platen roller 130, and has ribs 2220 that are a plurality of linear protrusions parallel to a paper feeding direction. The plurality of ribs 2220 includes those having a length across the support plate 2210 and those shorter than them and formed only at an edge portion on the paper insertion side, which are formed alternately in a paper width direction.

Therefore, paper is supported on lines by the ribs 2220 without contacting the support plate on its entire rear surface, and thus is easily fed to the platen roller 130 with reduced friction.

Numbers indicating the size of paper in the width direction are provided between the plurality of ribs 2220, and spaces between the ribs 2220 are set to dimensions indicated by the numbers. Therefore, the width of the paper guides 2130 and 2140 can be easily adjusted to the dimension for insertion.

A rail groove 2230 is provided between the rack-and-pinion gear and the support plate 2210 in parallel to the platen roller. The paper guide 2130 has a sliding member (not shown) that is inserted into the rail groove 2230 and can move while sliding in the rail groove 2230. With this, the sliding member moves along the rail groove 2230 while supporting the paper guide 2130, thus allowing the paper guide 2130 to be supported stably and moved along the rail groove 2230 without wobbling.

<Operation>

Figure 23:
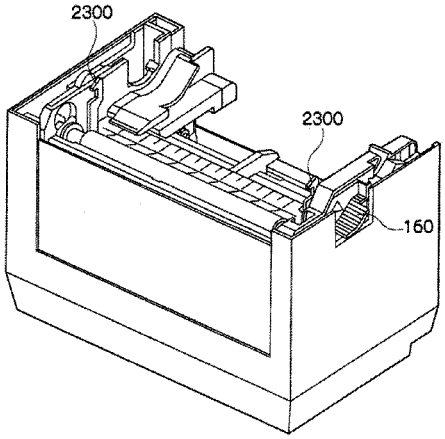
FIG. 23 is a perspective view of the lower unit only.

Next, the operation of the hinge portion of the printer will be described with reference to the drawings. FIG. 1(A) shows a state in which the upper unit 120 of the printer 100 is closed. At this time, as shown in FIG. 4, the upper casing 240 (that is, the upper unit 120) is biased by the spring 225 to pivot about the bracket cover 220. However, the upper unit 120 is latched by two claw members 2300, 2300 shown in FIG. 23 (FIG. 23 is a perspective view of the lower unit only) placed at the rear of opposite sides of the platen roller 130, so as not to open.

Here, the claw members 2300, 2300 have been illustrated as an example of a locking portion for locking the upper unit 120 to the lower unit 140 to make it in a closed state, and for unlocking it to make it in an open state. However, this is not limiting, and any means that allows the upper unit 120 to be locked and unlocked relative to the lower unit 140 may be used.

Here, by pressing an opening/closing lever 160, the claw members 2300, 2300 swing rearward, and a biasing force by the spring 225 causes the upper unit 120 to pivot about the bracket cover 220. At this time, the upper casing 240 starts pivoting from the state shown in FIG. 7, and the arc-shaped hole 610 in the ring portion 246 moves clockwise. However, as shown in FIG. 8, the arc-shaped member 510 butts against the stopper 706, and the upper casing 240 stops and does not pivot further. This state is shown in FIG. 1(B). In this manner, front opening can be performed. Since the stopper 706 is provided, opening to an angle more than or equal to a predetermined angle can be prevented.

Next, from a state shown in FIGS. 11(A) and 11(B), the circular protrusion 1110 is moved from within the semicircular groove 1104 toward the opening of the semicircular groove 1104 as shown in FIGS. 12(A) and 12(B). This is enabled by the bracket cover 220 and the upper hinge bracket 215 slightly bending due to their elasticity. Thus, for the bracket cover 220 and the upper hinge bracket 215, it is preferred in this example to use members having elasticity at least partly.

Thereafter, as shown in FIGS. 13(A) and 13(B), due to the elasticity of the bracket cover 220 and the upper hinge bracket 215, the semicircular groove 1104 returns to a fixed position in a lateral direction on the figure. In this state, the right side of the upper casing 240 is lifted upward, thereby opening the upper unit 120 upward about the pivot pin 210 shown in FIG. 10, opening to the right as shown in FIG. 9 into the fully open state.

Figure 24:
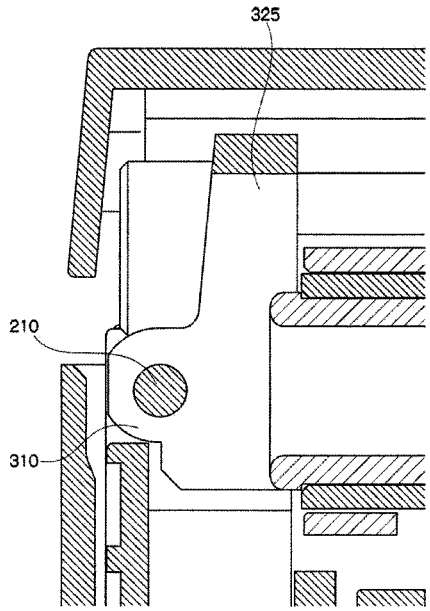
FIG. 24 is a view showing an end portion of the upper hinge bracket in the front open state or in a closed state.

In the state of the hinge portion at this time, before fully opened, as shown in FIG. 24 (FIG. 24 is a view showing an end portion of the upper hinge bracket in a front open or closed state), the U-member 325 of the upper hinge bracket 215 is in an upward-oriented state.

From here, by pivoting the upper hinge bracket 215 about the pivot pin 210, that is, pivoting the upper unit 120, the U-member 325 and the fork parts 310 are pivoted counter-clockwise with respect to the figure.

Figure 25:
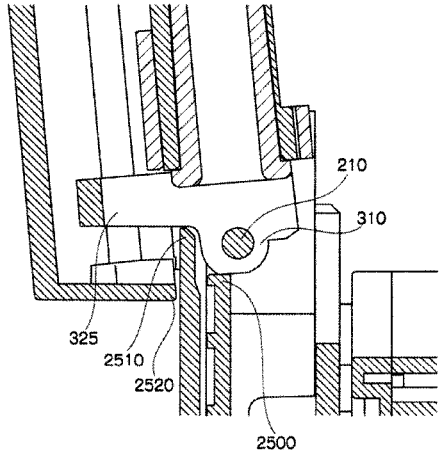
FIG. 25 is a view showing a state of the end portion of the upper hinge bracket when the upper unit is fully opened.

Thereafter, as shown in FIG. 25 (FIG. 25 is a view showing a state of the end portion of the upper hinge bracket when the upper unit is fully opened), the fork parts 310 and the U-member 325 butt against stoppers 2500 and 2510 formed at the lower hinge bracket 205, respectively, to be locked. At that time, a stopper 2520 formed at the upper unit 120 also butts against the stopper 2510 formed at the lower hinge bracket 205 to be locked.

REFERENCE SIGNS

100 printer
110 thermal head
120 upper unit
130 platen roller
140 lower unit
150 hinge portion
160 opening/closing lever
205 lower hinge bracket
210 pivot pin
215 upper hinge bracket
220 bracket cover
225 spring
230 screw
235 insertion hole
240 upper casing
245 ring portion
246 ring portion
250 upper cover
260 wiring groove
305 screw hole
310 fork part
315 rod-shaped body
320 pivot stopping hole
325 U-member
330 distal end surface hole
335 first side surface hole
340 second side surface hole
402 groove
405 groove
410 wiring
505 cylindrical member
510 arc-shaped member
605 circular hole
610 arc-shaped hole
705 stopper
706 stopper
910 screw
1104 semicircular groove
1110 circular protrusion
1120 wall
1130 protruding portion
1700 thermal head element
1702 mounting member
1704 flat plate member
1706 L-member
1710 pressing member
1720 spring
1730 pressing plate
1800 protrusion
1802 rectangular hole
1804 rectangular hole
1900 butted surface
2100 pinion gear
2110 rack
2120 rack
2130 paper guide
2132 upper guide
2134 lower guide
2140 paper guide
2144 lower guide
2200 paper support member
2210 support plate
2220 rib
2230 rail groove
2300 claw member
2500 stopper
2510 stopper
2520 stopper

The invention claimed is:

1. A printer comprising:

a print section including a platen roller for feeding paper and a thermal head arranged for printing on paper fed by the platen roller;

a lower unit including one of the platen roller and the thermal head;

an upper unit including the other of the platen roller and the thermal head;

a first pivot support portion provided along a direction parallel to a longitudinal direction of the platen roller, the first pivot support portion pivotably supporting the upper unit relative to the lower unit; and a second pivot support portion provided along a direction orthogonal to the longitudinal direction of the platen roller, the second pivot support portion pivotably supporting one end portion of the first pivot support portion;

wherein:

the first pivot support portion is provided at the upper unit; and a connecting portion is provided at the lower unit, the connecting portion pivotably supporting the upper unit via the first pivot support portion, and pivotably supporting the first pivot support portion via the second pivot support portion and supporting the first pivot support portion so as to be attachable and detachable from the connecting portion.

2. The printer according to claim 1, wherein the first pivot support portion has a biasing portion for biasing the upper unit in a direction in which the upper unit is released relative to the lower unit.

3. The printer according to claim 1, further comprising a locking portion which locks the upper unit into a closed state and unlocks the upper unit into a released state relative to the lower unit.

4. The printer according to claim 1, wherein the first pivot support portion and the upper unit are provided with a restricting portion, the restricting portion restricting the amount of pivoting of the upper unit that pivots on the first pivot support portion.

5. The printer according to claim 1, wherein the first pivot support portion includes a member having elasticity.

6. The printer according to claim 1, wherein the connecting portion has a first groove for supporting one end portion of the first pivot support portion that is supported by the second pivot support portion, and a second groove for supporting the other end portion of the first pivot support portion, the first groove having an opening formed to face vertically upward, the second groove having an opening formed at an inclination with respect to a vertically top portion.

7. The printer according to claim 6, wherein the second groove is formed with a protruding portion at which an inner wall of the groove is protruded on a path of the other end portion of the first pivot support portion when the first pivot support portion pivots on the second pivot support portion.

8. An opening/closing apparatus comprising:

a lower unit;

an upper unit that is openable and closable relative to the lower unit;

a first pivot support portion constituting a pivot for allowing the upper unit to be opened or closed in a first direction; and a second pivot support portion for supporting one end portion of the first pivot support portion, the second pivot support portion constituting a pivot for allowing the upper unit to be opened or closed in a second direction that is different from the first direction; wherein:

the first pivot support portion is provided at the upper unit; and a connecting portion is provided at the lower unit, the connecting portion pivotably supporting the upper unit via the first pivot support portion, and pivotably supporting the first pivot support portion via the second pivot support portion, and supporting the first pivot support portion so as to be attachable and detachable from the connecting portion.

9. The opening/closing apparatus according to claim 8, wherein the first pivot support portion has a biasing portion for biasing the upper unit in a direction in which the upper unit is released relative to the lower unit.

10. The opening/closing apparatus according to claim 8, further comprising a locking portion which locks the upper unit into a closed state and unlocks the upper unit into a released state relative to the lower unit.

11. The opening/closing apparatus according to claim 8, wherein the first pivot support portion and the upper unit are provided with a restricting portion for restricting the amount of pivoting of the upper unit that pivots on the first pivot support portion.

12. The opening/closing apparatus according to claim 8, wherein the first pivot support portion includes a member having elasticity.

13. The opening/closing apparatus according to claim 8, wherein the connecting portion has a first groove for supporting one end portion of the first pivot support portion that is supported by the second pivot support portion, and a second groove for supporting the other end portion of the first pivot support portion, the first groove having an opening formed to face vertically upward, the second groove having an opening formed at an inclination with respect to a vertically top portion.

14. The opening/closing apparatus according to claim 13, wherein the second groove is formed with a protruding portion at which an inner wall of the groove is protruded on a path of the other end portion of the first pivot support portion when the first pivot support portion pivots on the second pivot support portion.

* * * * *